US010597204B2

(12) United States Patent
Levy et al.

(10) Patent No.: US 10,597,204 B2
(45) Date of Patent: Mar. 24, 2020

(54) TRAVEL BOTTLE WITH SLIDE LOCK

(71) Applicant: Navajo Manufacturing Company, Inc., Denver, CO (US)

(72) Inventors: Gordon Levy, Golden, CO (US); Shawn Shelton, Denver, CO (US)

(73) Assignee: Navajo Manufacturing Company, Inc., Denver, CO (US)

( * ) Notice: Subject to any disclaimer, the term of this patent is extended or adjusted under 35 U.S.C. 154(b) by 160 days.

(21) Appl. No.: 15/900,085

(22) Filed: Feb. 20, 2018

(65) Prior Publication Data

US 2019/0256258 A1 Aug. 22, 2019

(51) Int. Cl.

*B65D 50/04* (2006.01)
*B65D 47/08* (2006.01)
*B65D 47/28* (2006.01)

(52) U.S. Cl.

CPC ..... *B65D 50/045* (2013.01); *B65D 47/0814* (2013.01); *B65D 47/0842* (2013.01); *B65D 47/286* (2013.01); *B65D 2251/1008* (2013.01); *B65D 2251/1025* (2013.01); *B65D 2547/066* (2013.01)

(58) Field of Classification Search

CPC ..... B65D 50/045; B65D 47/0804; B65D 2251/1025; B65D 2251/1016; B65D 2547/066; B65D 51/18; B65D 55/14; B65D 43/22; B65D 45/00; B65D 45/16; B65D 2251/1008; B65D 2251/1058; B60K 15/0409

USPC ..... 215/216, 243, 234, 235, 237; 220/254.9, 220/244, 263, 810, 831–833, 315, 324, 220/210

See application file for complete search history.

(56) References Cited

U.S. PATENT DOCUMENTS

| | | | | |
|---|---|---|---|---|
| 2,582,360 | A | 1/1952 | Sheridan | |
| 3,094,255 | A | 6/1963 | Hunter | |
| 3,358,890 | A | 12/1967 | Dalfo | |
| 3,460,719 | A | 8/1969 | O'Donnell et al. | |
| 3,484,023 | A | 12/1969 | Meshberg | |
| 3,655,099 | A | 4/1972 | Hazard | |
| 3,784,060 | A | 1/1974 | Hazard | |
| 3,847,313 | A | 11/1974 | Micallef | |
| 3,848,778 | A | 11/1974 | Meshberg | |
| 3,873,005 | A | 3/1975 | Hazard | |
| 3,874,568 | A | 4/1975 | La Vange et al. | |
| 4,081,113 | A | 3/1978 | Hazard | |
| 4,299,339 | A | 11/1981 | Giroux et al. | |
| 4,487,342 | A | 12/1984 | Shy | |
| 4,500,016 | A | 2/1985 | Funfstuck | |
| 4,542,837 | A | 9/1985 | Rayner | |
| 4,591,079 | A | 5/1986 | Bigotte | |
| 4,645,086 | A | 2/1987 | Rosenthal | |
| 4,666,068 | A | 5/1987 | Bush | |
| 4,776,501 | A | 10/1988 | Ostrowsky | |
| 4,779,773 | A | 10/1988 | Bennett | |
| 4,852,770 | A * | 8/1989 | Sledge | B65D 47/0814 222/153.14 |
| 4,962,869 | A | 10/1990 | Gross et al. | |

(Continued)

*Primary Examiner* — Shawn M Braden

(74) *Attorney, Agent, or Firm* — Studebaker & Brackett PC

(57) ABSTRACT

A bottle includes a secure sealing mechanism. A slide switch plate maintains the contents of the bottle. This is achieved by securing a dispensing mechanism in a closed, locked position and sealing an outlet so that any liquids are prevented from exiting the bottle.

16 Claims, 6 Drawing Sheets

(56) References Cited

U.S. PATENT DOCUMENTS

| | | | | |
|---|---|---|---|---|
| 5,141,129 | A | 8/1992 | Jennings | |
| 5,284,264 | A | 2/1994 | Gross | |
| 5,429,256 | A | 7/1995 | Kestenbaum | |
| D370,845 | S | 6/1996 | Sherman et al. | |
| 5,577,626 | A | 11/1996 | Henkel et al. | |
| D434,659 | S | 12/2000 | Lonczak et al. | |
| D438,799 | S | 3/2001 | Anderson | |
| 6,283,333 | B1 | 9/2001 | Knickerbocker et al. | |
| D455,077 | S | 4/2002 | Gaiser et al. | |
| 6,866,164 | B2 | 3/2005 | Branson et al. | |
| D508,853 | S | 8/2005 | Ziegenhorn et al. | |
| D524,650 | S | 7/2006 | Sitomer | |
| D537,721 | S | 3/2007 | Kertels | |
| D585,742 | S | 2/2009 | Wilson et al. | |
| 7,611,029 | B2 * | 11/2009 | Wong | B65D 47/286 220/254.9 |
| D627,638 | S | 11/2010 | Bodet et al. | |
| D638,705 | S | 5/2011 | Schawo | |
| D649,055 | S | 11/2011 | Fracasso | |
| D688,554 | S | 8/2013 | Fracasso | |
| D722,267 | S | 2/2015 | Miranda De Araujo et al. | |
| 9,120,605 | B1 | 9/2015 | Mar | |
| D750,492 | S | 3/2016 | Campbell et al. | |
| D755,048 | S | 5/2016 | Baissero et al. | |
| D759,484 | S | 6/2016 | Pastre | |
| 9,498,311 | B2 | 11/2016 | Kelchlin | |
| 10,167,120 | B1 | 1/2019 | Levy et al. | |
| 2003/0038146 | A1 | 2/2003 | Meshberg | |
| 2004/0112927 | A1 | 6/2004 | Kaufman et al. | |
| 2006/0261068 | A1 * | 11/2006 | Schmidtner et al. | B65D 43/0208 220/254.9 |
| 2007/0170184 | A1 * | 7/2007 | Canedo | B65D 43/0208 220/254.9 |
| 2015/0090736 | A1 | 4/2015 | Erickson et al. | |

* cited by examiner

TRAVEL BOTTLE WITH SLIDE LOCK

FIELD OF THE INVENTION

The present invention relates to the field of bottles which require a secure locking to prevent accidental dispensing of its contents.

BACKGROUND OF THE INVENTION

Oftentimes, when traveling, individuals carry miniaturized versions of full sized liquid content bottles. However, the problem encountered is that the small, travel size bottles often leak or accidentally dispense fluids due to contact with the bottle or pressurization of an airline compartment which forces liquids from the bottle. This causes a mess throughout all of the travel contents.

SUMMARY OF THE INVENTION

By the present invention, a bottle includes a secure sealing mechanism. A slide switch plate maintains the contents of the bottle. This is achieved by securing a dispensing mechanism in a closed, locked position and sealing an outlet so that any liquids are prevented from exiting the bottle.

This is achieved by the use of a bottle cap having a lid that can be opened and closed. When in the closed position the bottle is "locked" by a slide switch plate moved to a locked position. The locked position is indicated by markings on a top body of a cap.

Additional safeguards are implemented so that if the switch plate is in the unlocked position, the lid cannot be closed. This would alert the user that the switch plate has not been transitioned to the locked position.

When the slide switch is moved to a locked position, the slide switch covers the outlet channel of the bottle. The lid is then permitted to be closed. This keeps the contents of the bottle from being dispensed under pressure.

Accordingly, it is an object of the present invention to provide a travel bottle with a slide switch plate lock.

It is another object of the present invention to provide a travel bottle with a slide switch plate lock to move between a locked position and an unlocked position.

It is still yet another object of the present invention to provide a travel bottle with a slide switch plate lock to move between a locked position and an unlocked position and preventing a lid of the locking mechanism from being closed in the unlocked position of the slide switch plate lock.

It is still another object of the present invention to provide a travel bottle with a slide switch plate lock to move between a locked position and an unlocked position and preventing a lid of the locking mechanism from being closed in the unlocked position of the slide switch plate lock and allowing the closing of the lid in the locked position of the slide switch plate lock.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

DETAILED DESCRIPTION OF THE PREFERRED EMBODIMENTS

Figure 1:
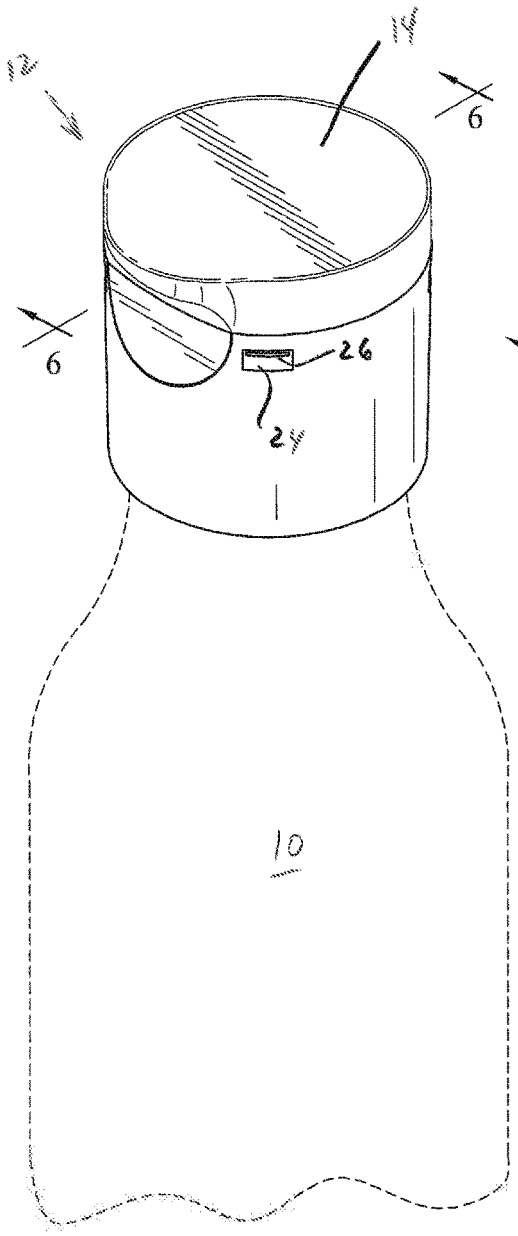
FIG. 1 illustrates a slide switch plate lock of a locking mechanism of the present invention mounted on a bottle in a locked position.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
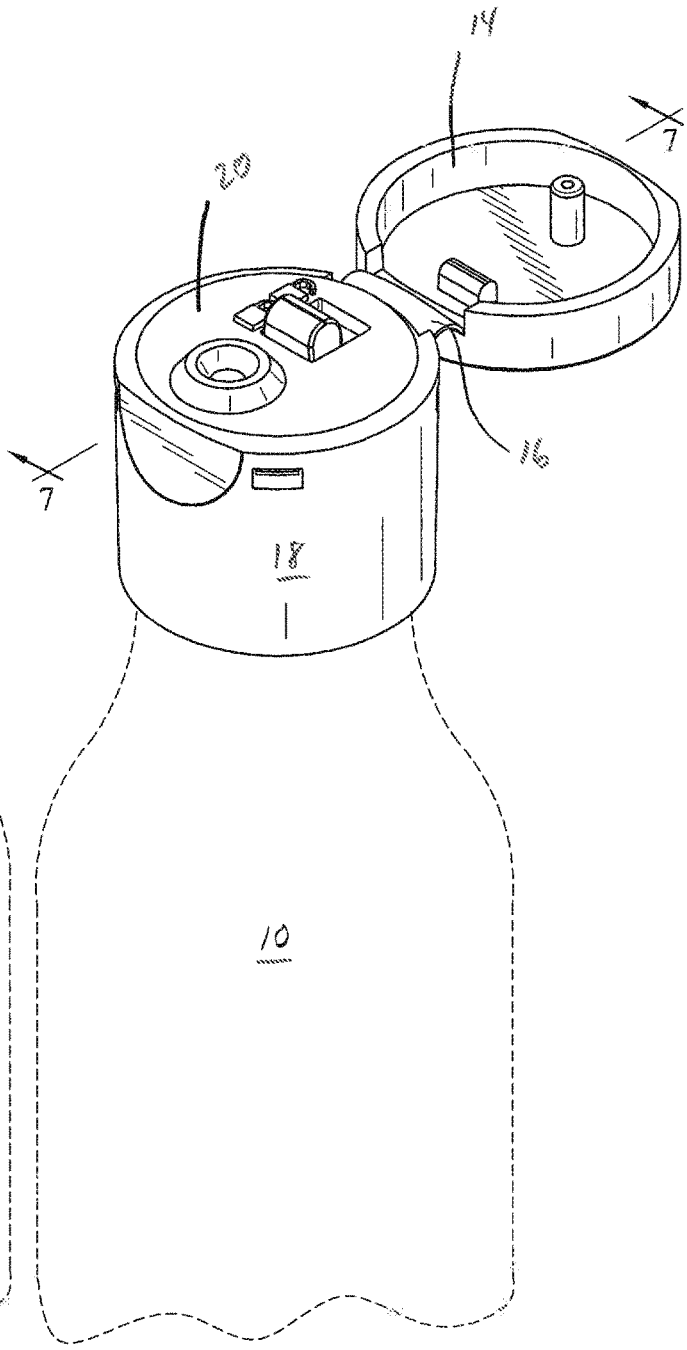
FIG. 2 illustrates an exposed lid of the locking mechanism showing the slide switch plate lock of the present invention mounted on a bottle in the locked position.
Figure 3:
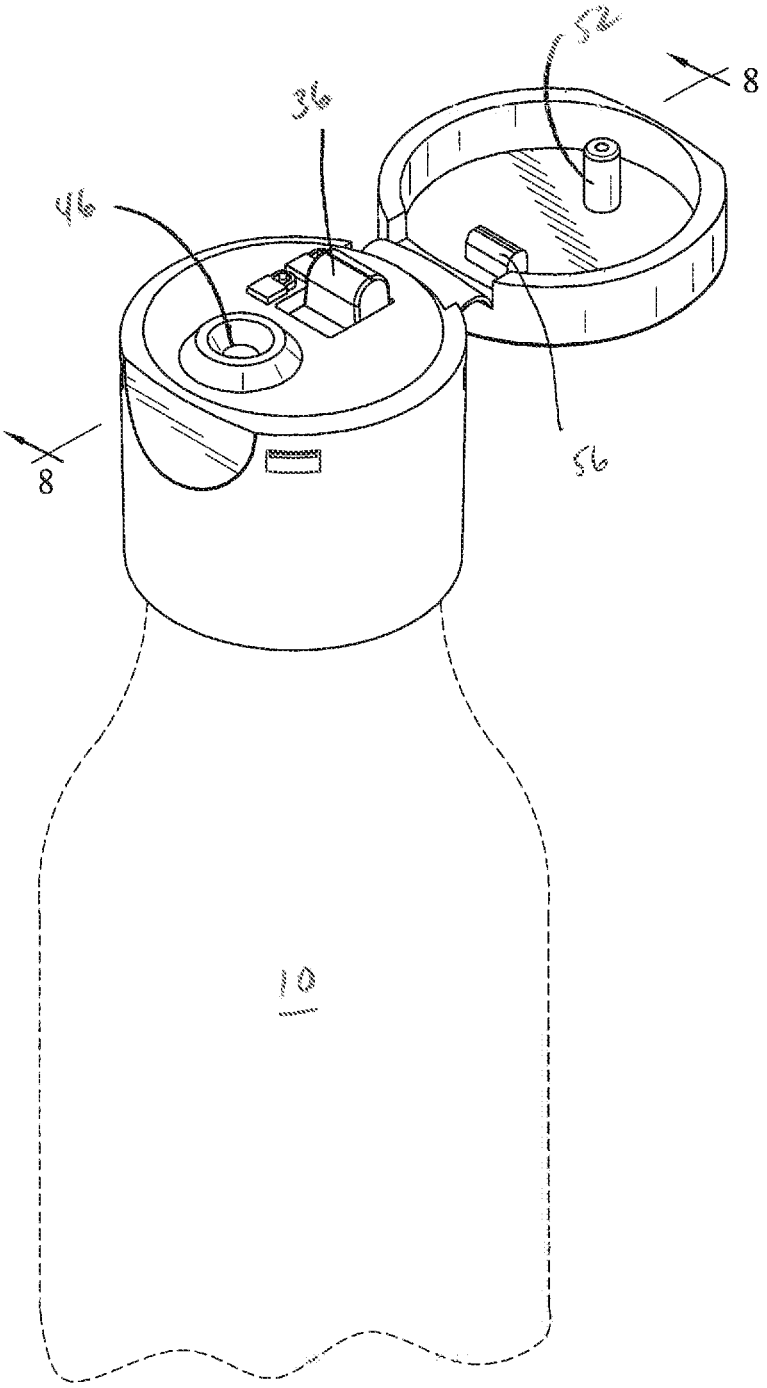
FIG. 3 illustrates the exposed lid of the locking mechanism showing the slide switch plate lock of the present invention mounted on a bottle in the unlocked position.
Figure 5:
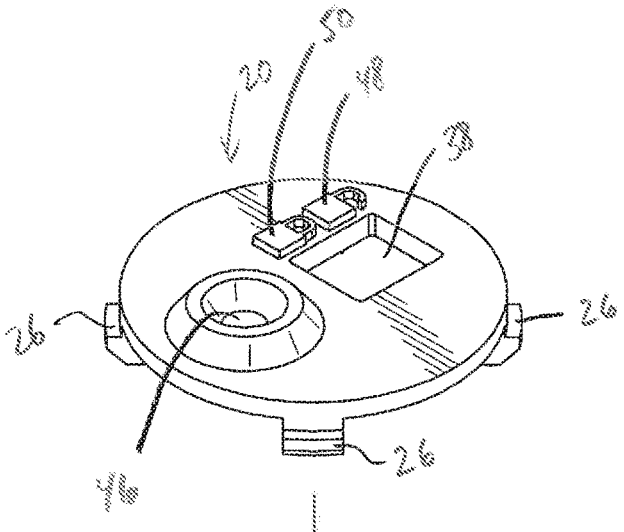
FIG. 5 is a bottom view of the slide switch plate.
Figure 5:
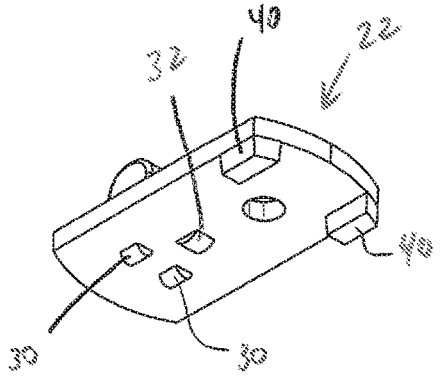

As shown in FIGS. 1 through 3, a travel bottle 10 includes a locking mechanism 12 threadably mounted on the bottle 10. A lid 14 is pivotally mounted by a living hinge 16 onto main body 18. Secured to the main body 18 is a top body 20. Interposed between the main body 18 and the top body 20 is a slide switch plate 22 as best shown in FIGS. 4 and 5.

Figure 4:
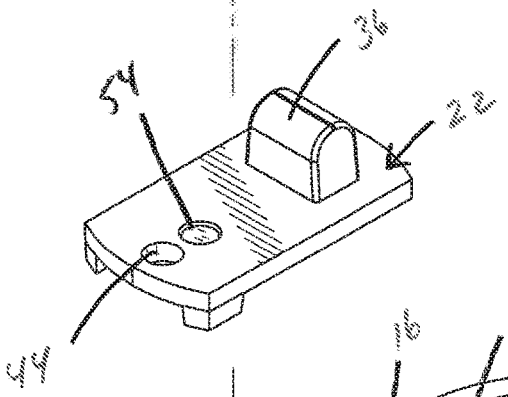
FIG. 4 is an exploded view of the locking mechanism showing a top body and a main body, with a slide switch plate located between the top body and the main body.
Figure 4:
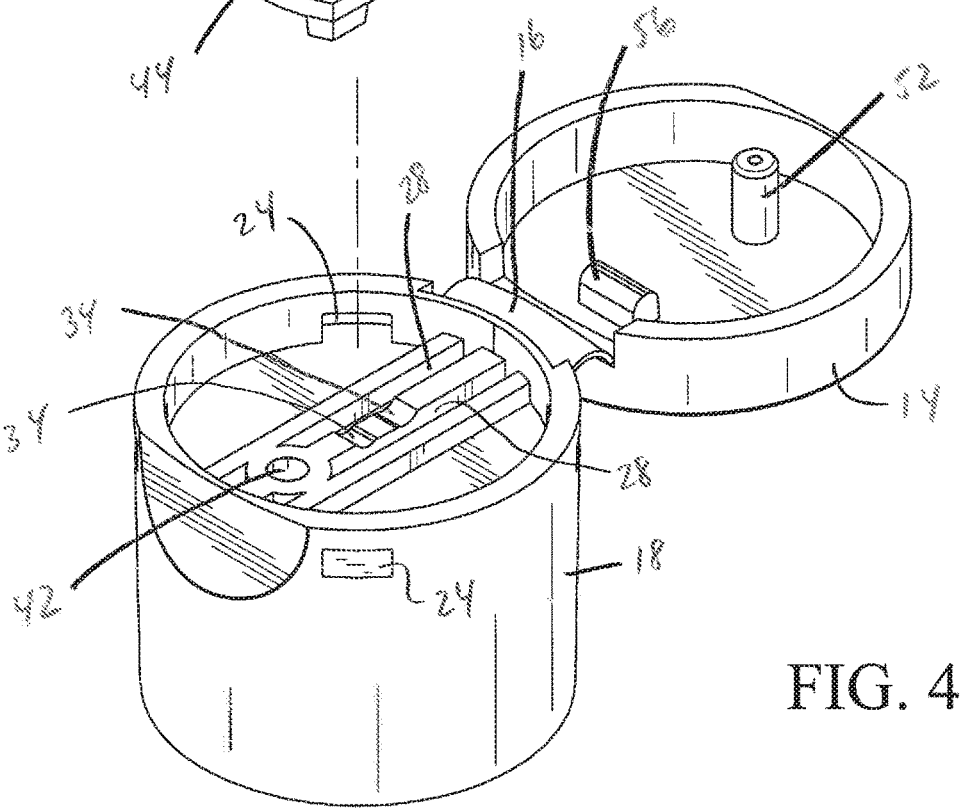

In FIG. 4, the main body 18 includes a plurality of openings 24 spaced about its periphery for receipt of teeth 26 of the top body 20. The teeth 26 fit within the openings 24 to secure the two pieces together with the slide switch plate therebetween.

The main body 18 also includes guide tracks 28 for cooperating with projections 30 located on the underside of the switch plate 22. Extrusions 40 provide glide and guide assistance along the outside of the guide tracks 28 while the projections 30 slide in the guide tracks 28.

Another projection 32 on the underside of the switch plate 22 is shaped to cooperate with a plurality of spaced recesses 34 located between the guide tracks 28 of the main body 18. The projection 32 locks the switch plate in its locked and unlocked positions within the recesses 34. The switch plate 22 is moved by sliding movements of the handle 36 which projects through opening 38 in top body 20.

Passage of fluids from the bottle 10 is achieved by passage through opening 42 in the main body 18. The opening 42 communicates with the interior of the bottle 10. To allow continued passage of the fluids from the bottle, the fluids pass through opening 44 in the switch plate 22 when the switch plate is in the unlocked position. This allows passage of the liquid contents of the bottle 10 to exit through the through hole 46 in the top body 20. The unlocked position of the switch plate 22 is caused by positioning the handle 36 at the rear most portion of opening 38, aligned with unlocked icon 48.

Figure 7:
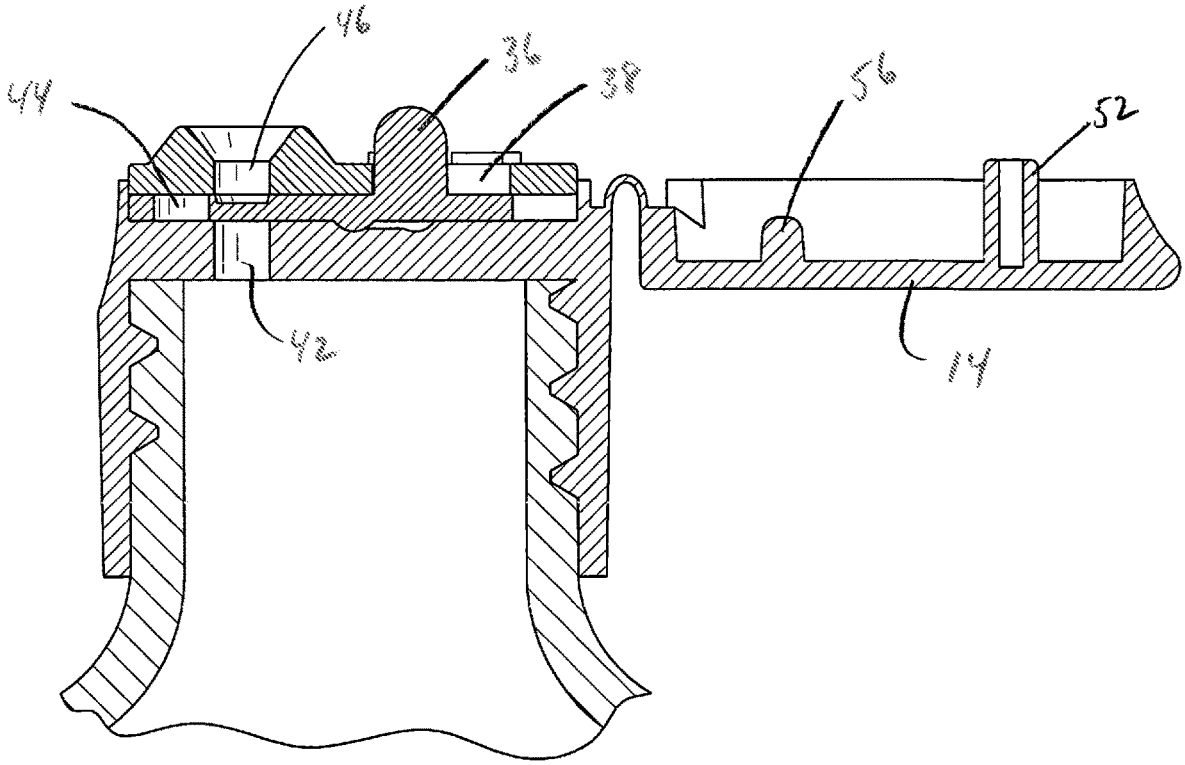
FIG. 7 is a sectional view taken along line 7-7 as shown in FIG. 2.

When the handle 36 is slid forward in the opening 38 to be aligned with locked icon 50, the switch plate covers the opening 42 in the main body 18 as shown in FIG. 7. In the locked position of the switch plate the liquid contents of the bottle 10 are not permitted to exit.

Figure 6:
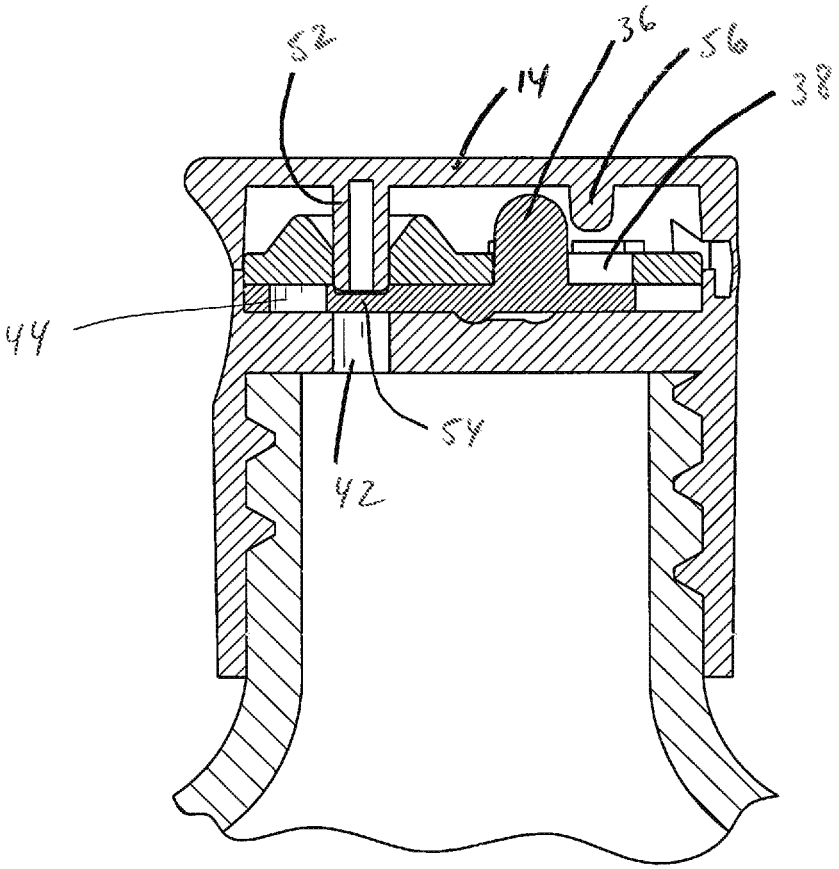
FIG. 6 is a sectional view taken along line 6-6 as shown in FIG. 1.

In the locked position of the switch plate, a plug 52 on the lid 14 is allowed to pass through the opening 46 of the main body 20 and rest within a partial recess 54 of the switch plate 22 as shown in FIG. 6. In this position, with the handle 36 slid forward, the opening 42 is blocked by the switch plate 22 and the plug 52 extends through hole 46 and is seated in recess 54. This acts as a snap feature to keep the lid closed and to keep the fluid from coming out of the bottle.

Another feature assisting in maintaining the lid 14 in a closed, locked position is a projection 56 on the same interior surface of the lid 14 as the plug 52. This projection 56, in the locked position of the switch plate 22 is permitted to be seated behind the handle 36 in the gap formed between the handle 36 and the exposed portion of opening 38, as is also shown in FIG. 6.

Figure 8:
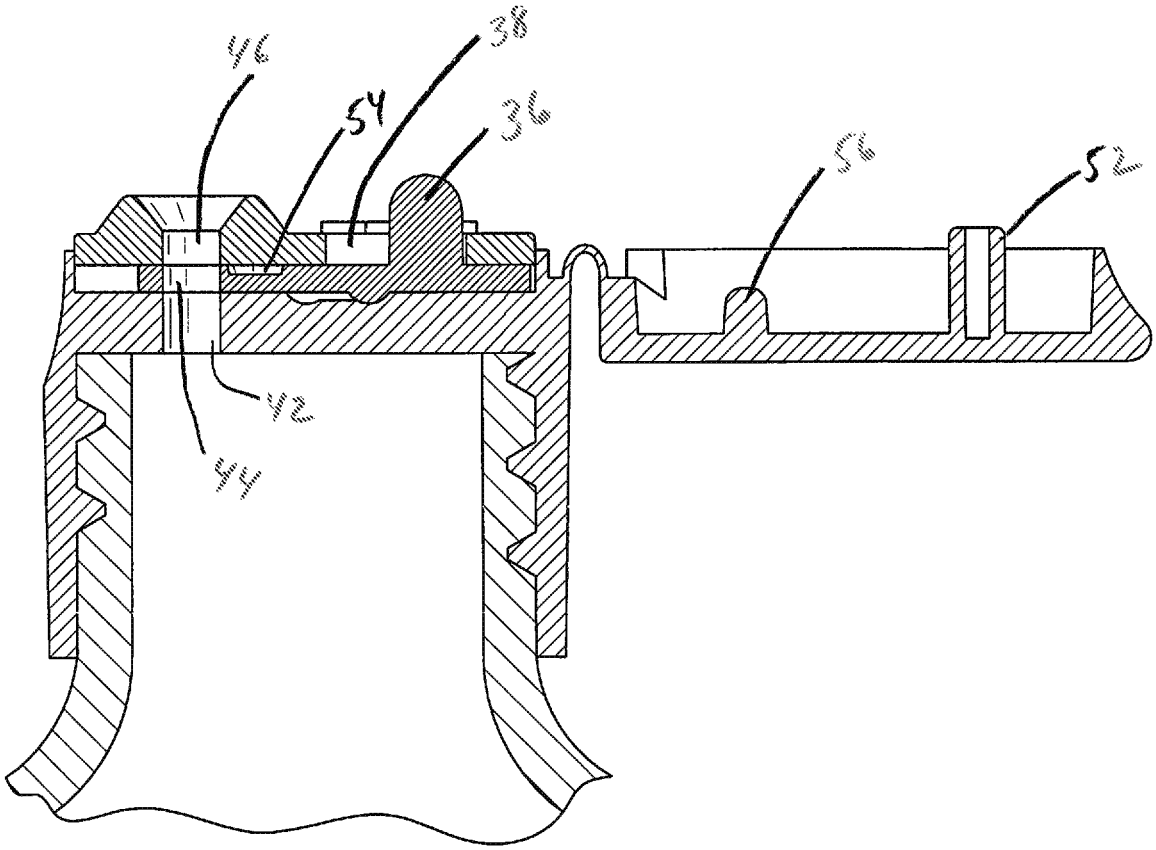
FIG. 8 is a sectional view taken along line 8-8 as shown in FIG. 3.

When the switch plate 22 is in the unlocked position, as shown in FIG. 8, the lid 14 is not permitted to close because the projection 56 would engage with the top of the handle 36. This is a safeguard against closing the lid 14 while the switch plate is in the unlocked position.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A cap of a dispensing bottle, said cap comprising
a main body having a lid,
a top body secured to said main body, and
a switch plate secured between said main body and said top body, said switch plate including a handle for moving said switch plate between a locked position and an unlocked position, said lid being closeable when said switch plate is in said locked position and said lid being prevented from closing when said switch plate is in said unlocked position,
said lid including a projection, said projection engaging said handle to prevent closure of said lid when said switch plate is in said unlocked position,
said projection avoiding contact with an upper end of said handle to allow said lid to be closed when said switch plate is in said locked position.

2. The cap of a dispensing bottle according to claim 1, wherein said main body, said top body and said switch plate each including a passageway, said passageway of said main body, said passageway of said top body and said passage way of said switch plate are aligned for passageway therethrough of a liquid when said switch plate is in said unlocked position.

3. The cap of a dispensing bottle according to claim 2, wherein said lid is pivotally mounted on said main body to close said passageway of said top body when said switch plate is in said locked position.

4. The cap of a dispensing bottle according to claim 3, wherein said lid includes a plug sized to fit in said passageway of said top body.

5. The cap of a dispensing bottle according to claim 4, wherein said switch plate includes a recess for the receipt of said plug when said lid is closed and said switch plate is in said locked position with said plug extending through said passageway of said top body.

6. The cap of a dispensing bottle according to claim 2, wherein said passageway of said main body and said passageway of said top body are blocked by said plate when said switch plate is in said locked position.

7. The cap of a dispensing bottle according to claim 1, wherein said handle projects through an opening of said top body.

8. The cap of a dispensing bottle according to claim 1, wherein said switch plate includes guide elements cooperating with tracks of said main body for sliding of said switch plate and holding said switch plate in the locked position or the unlocked position.

9. A cap of a dispensing bottle, said cap comprising
a main body having a lid,
a top body secured to said main body, and
a switch plate secured between said main body and said top body, said switch plate including a handle for moving said switch plate between a locked position and an unlocked position, said lid being closeable and covering said top body when said switch plate is moved by said handle to said locked position and said lid plate being prevented from closing when said switch plate is moved by said handle to said unlocked position,
said lid including a projection, said projection engaging said handle to prevent closure of said lid when said switch plate is in said unlocked position,
said projection avoiding contact with an upper end of said handle to allow said lid to be closed when said switch plate is in said locked position.

10. The cap of a dispensing bottle according to claim 9, wherein said main body, said top body and said switch plate each including a passageway, said passageway of said main body, said passageway of said top body and said passageway of said switch plate are aligned for passageway therethrough of a liquid when said switch plate is in said unlocked position.

11. The cap of a dispensing bottle according to claim 10, wherein said lid is pivotally mounted on said main body to close said passageway of said top body when said switch plate is in said locked position.

12. The cap of a dispensing bottle according to claim 11, wherein said lid includes a plug sized to fit in said passageway of said top body.

13. The cap of a dispensing bottle according to claim 12, wherein said switch plate includes a recess for the receipt of said plug when said lid is closed and said switch plate is in said locked position with said plug extending through said passageway of said top body.

14. The cap of a dispensing bottle according to claim 10, wherein said passageway of said main body and said passageway of said top body are blocked by said plate when said switch plate is in said locked position.

15. The cap of a dispensing bottle according to claim 9, wherein said handle projects through an opening of said top body.

16. The cap of a dispensing bottle according to claim 9, wherein said switch plate includes guide elements cooperating with tracks of said main body for sliding of said switch plate and holding said switch plate in the locked position or the unlocked position.

* * * * *